US009719203B2

(12) United States Patent
Maiero

(10) Patent No.: US 9,719,203 B2
(45) Date of Patent: Aug. 1, 2017

(54) WASHING MACHINE PUMP

(71) Applicant: Electrolux Appliances Aktiebolag, Stockholm (SE)

(72) Inventor: Marco Maiero, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 14/782,212

(22) PCT Filed: Apr. 2, 2014

(86) PCT No.: PCT/EP2014/056557
§ 371 (c)(1),
(2) Date: Oct. 2, 2015

(87) PCT Pub. No.: WO2014/161869
PCT Pub. Date: Oct. 9, 2014

(65) Prior Publication Data

US 2016/0047079 A1 Feb. 18, 2016

(30) Foreign Application Priority Data

Apr. 5, 2013 (EP) ..... 13162583

(51) Int. Cl.
*D06F 39/04* (2006.01)
*D06F 39/08* (2006.01)

(52) U.S. Cl.
CPC ..... *D06F 39/085* (2013.01); *D06F 39/04* (2013.01); *D06F 39/083* (2013.01)

(58) Field of Classification Search
CPC ..... D06F 39/04; D06F 39/083; D06F 39/085
(Continued)

(56) References Cited

U.S. PATENT DOCUMENTS 4,487,111 A * 12/1984 Prince ..... F15B 15/065 92/110
2002/0153029 A1* 10/2002 Cerruti ..... A47L 15/4409 134/29

FOREIGN PATENT DOCUMENTS

IT EP 2267211 A1 * 12/2010 ..... D06F 39/083

* cited by examiner

*Primary Examiner* — Michael Barr
*Assistant Examiner* — Levon J Shahinian
(74) *Attorney, Agent, or Firm* — Banner & Witcoff, Ltd.

(57) ABSTRACT

A laundry washing machine (100) has a washing tub (107) in which washing/rinsing liquid may be loaded; a rotatable perforated drum (110), in which laundry (112) to be washed can be loaded; a discharge system (145, 150) fluidly connected to the washing tub (107) and adapted to selectively discharge washing/rinsing liquid from the washing tub (107), the discharge system (145, 150) including a discharge duct (150) coupled with the washing tub (107) for receiving washing/rinsing liquid to be discharged; a pump (170) operable to selectively cause washing/rinsing liquid located in the discharge duct (150) to be discharged through a drain hose (175) or to be conveyed back into the washing tub (107) through a recirculation conduit (180). The pump (170) has: a) a pump chamber (230) for receiving washing/rinsing liquid from the discharge duct (150); b) a diverter element (240) movably arranged in the pump chamber (230) and movable between a first position, in which the diverter element (240) causes washing/rinsing liquid in the pump chamber (230) to be diverted to the recirculation conduit (180), and a second position, in which the diverter element (240) causes washing/rinsing liquid in the pump chamber (230) to be diverted to the drain hose (175).

14 Claims, 7 Drawing Sheets

(58) Field of Classification Search
USPC ..... 68/139, 147, 184, 207, 208
See application file for complete search history.

WASHING MACHINE PUMP

The present invention generally relates to the field of household appliances. More specifically, the present invention relates to laundry washing machines and laundry washing/drying machines, both for domestic and professional use.

BACKGROUND

Laundry washing and washing/drying machines (hereinafter simply referred to as "washing machines") are household appliances designed to wash laundry and typically comprise a washing tub housing a rotatable perforated drum in which the laundry to be washed can be loaded/unloaded.

In order to carry out washing operations on laundry loaded into the drum, washing liquid (e.g., water, water mixed with washing products and/or water mixed with rinsing products) is introduced—through an inlet line—in the washing tub of the washing machine during a washing liquid loading phase. Being the drum perforated, the washing liquid penetrates thereinto, soaking the laundry.

Then, a washing phase is started in which the drum is rotated, so that the laundry loaded into the drum is washed thanks to the chemical reactions exerted by the washing liquid, and to the mechanical action exerted by the tumbling action caused by the rotation of the drum.

At the end of the washing phase, the washing liquid (which is at this point mixed with dirt particles removed from the laundry) is drained from the washing tub for allowing the carrying out of rinsing and/or spin-drying operations on the laundry.

For this purpose, the washing machine is provided with a discharge system adapted to selectively drain the washing liquid from the washing tub. The discharge system comprises a discharge duct for receiving washing liquid from the washing tub. For this purpose, the discharge duct is fluidly coupled with the washing tub through a discharge hole provided at the bottom of the washing tub. A drain pump, usually positioned downstream the discharge duct, is operable to cause the washing liquid located into the discharge duct to be discharged through a drain hose adapted to be connected to the water drain network system.

Some known washing machines are also provided with a recirculation system which, during the washing liquid loading phase and/or washing phase and/or rinsing phase, takes some liquid from the bottom of the tub (typically via the discharge duct), and reintroduces this liquid into a different region of the washing tub, or directly into the drum, so as to deliver the liquid to the laundry from more than one directions, and not only from the bottom of the tub; this allows a better wetting of the laundry, and therefore using a smaller amount of liquid during the above mentioned phase(s).

According to a solution known in the art, the recirculation system comprises a recirculation conduit fluidly coupled with the discharge duct and a recirculation pump, usually positioned downstream the discharge duct in parallel with the drain pump, which is operable to cause the washing liquid located into the discharge duct to be reintroduced into the washing tub through the recirculation conduit. The recirculation conduit feeds one or more nozzles arranged to spray the recirculated washing liquid into the washing tub, for example directly inside the drum.

According to this solution, when the recirculation pump is active and the drain pump is off, washing liquid is taken from the discharge duct and sprayed back into the drum; when the recirculation pump is off and the drain pump is active, washing liquid located in the discharge duct is instead discharged through the drain hose. This solution is quite expensive, since it provides for two dedicated pumps, i.e., the drain pump and the recirculation pump. Moreover, since such two pumps have to be installed in parallel with each other downstream the discharge duct, the installation thereof is quite time consuming and it also disadvantageously reduces the space available in the washing machine for housing other hydraulic, mechanic and/or electric apparatuses of the washing machine.

SUMMARY OF SELECTED INVENTIVE ASPECTS

An aim of the present invention is therefore reducing the production/assembly costs of laundry washing machines provided with a recirculation system.

Within this aim, a further object of the invention is reducing the overall dimensions of the recirculation system of a laundry washing machine, so as to increase the space available for housing other hydraulic, mechanic and/or electric apparatuses of the washing machine.

Applicant has found that by using a pump operable to selectively cause washing/rinsing liquid located into the washing tub of the machine to be discharged outside the machine or to be conveyed back into the washing tub, the pump comprising a pump chamber for receiving washing/rinsing liquid from the washing tub and a diverter element movably arranged in the pump chamber and movable between a first position, in which it causes washing liquid in the pump chamber to recirculated, and a second position, in which the diverter element causes washing liquid in the pump chamber to be drained outside the machine, it is possible using a single pump both for recirculating and for draining the washing/rinsing liquid, which allows reducing the production/assembly costs of the machine.

In addition, since the diverter element is arranged in the pump chamber, the pump keeps a very compact structure, which allows reducing the overall dimensions of the recirculation system.

In particular, one aspect of the present invention proposes a laundry washing machine comprising:

- a washing tub in which washing/rinsing liquid may be loaded;
- a rotatable perforated drum, in which laundry to be washed can be loaded;
- a discharge system fluidly connected to the washing tub and adapted to selectively discharge washing/rinsing liquid from the washing tub, the discharge system including a discharge duct coupled with the washing tub for receiving washing/rinsing liquid to be discharged;
- a pump operable to selectively cause washing/rinsing liquid located in the discharge duct to be discharged through a drain hose or to be conveyed back into the washing tub through a recirculation conduit.

The pump comprises:

a) a pump chamber for receiving washing/rinsing liquid from the discharge duct;

b) a diverter element movably arranged in the pump chamber and movable between a first position, in which the diverter element causes washing/rinsing liquid in the pump chamber to be diverted to the recirculation conduit, and a second position, in which the diverter element causes washing/rinsing liquid in the pump chamber to be diverted to the drain hose.

In a preferred embodiment, the pump comprises a linear actuator coupled to the diverter element and operable to move the diverter element the between the first and the second position. Using a linear actuator is particularly advantageous, since it is much less expensive and easy to be controlled than, for example, a rotating electric motor which needs a complex electric control and/or using link gears or crank gears in order to be able to move the diverter element in the two positions.

In a further advantageous embodiment, the pump comprises: an input port connected to the discharge duct, a drain output port connected to the drain hose, and a recirculation output port connected to the recirculation conduit; the discharge duct, the drain hose and the recirculation conduit are adapted to be brought in fluid communication with the pump chamber through the input port, the drain output port, and the recirculation output port, respectively. In this advantageous embodiment the diverter element is arranged in such a way to block the drain output port and to keep opened the recirculation output port when in the first position, and to block the recirculation output port and to keep opened the drain output port when in the second position.

In a further preferred embodiment the diverter element comprises a hollow member provided with: an input opening facing the input port, and a further opening arranged in such a way to face the recirculation output port when the diverter element is in the first position and adapted to face the drain output port when the diverter element is in the second position.

Preferably, the diverter element is rotatably arranged in the pump chamber and it is movable in the first and second positions by rotation.

More preferably, the linear actuator comprises a linear gear bar having teeth that mesh with corresponding teeth provided on the diverter element.

In an advantageous embodiment in which the diverter element is rotatably arranged in the pump chamber and is movable in the first and second positions by rotation, and in which the linear actuator comprises a linear gear bar having teeth that mesh with corresponding teeth provided on the diverter element, the linear gear bar is preferably operable to be moved along a linear direction between a retracted position and an extended position, the movement of the linear gear bar along the linear direction being converted into a corresponding rotational movement of the diverter element by means of mechanical interaction of the teeth of the linear gear bar with the teeth provided on the diverter element.

Preferably, when the linear gear bar is in the retracted position, the diverter element is in the first position, and when the linear gear bar is in the extended position, the diverter element is in the second position, or when the linear gear bar is in the retracted position, the diverter element is in the second position, and when the linear gear bar is in the extended position, the diverter element is in the first position.

In an advantageous embodiment, the linear actuator comprises: a block of wax, an end of the linear gear bar being fixed to a portion of the block of wax, and a heating device operable to selectively heat the block of wax.

Preferably, when the heating device is activated, the block of wax is heated and expands, driving the linear gear bar toward the extended position, and when the heating device is deactivated, the block of wax cools down and contracts, driving the linear gear bar toward the retracted position.

In a preferred embodiment, the linear actuator is controlled by an electronic control system of the washing machine, in such a way to selectively position the diverter element in the first or in the second position, according to the phase of the specific washing program selected by the user which is being performed.

BRIEF DESCRIPTION OF THE DRAWINGS

These, and others, features and advantages of the solution according to the present invention will be better understood by reading the following detailed description of some embodiments thereof, provided merely by way of exemplary and non-limitative examples, to be read in conjunction with the attached drawings, wherein.

DETAILED DESCRIPTION OF EXAMPLE EMBODIMENTS

Figure 1:
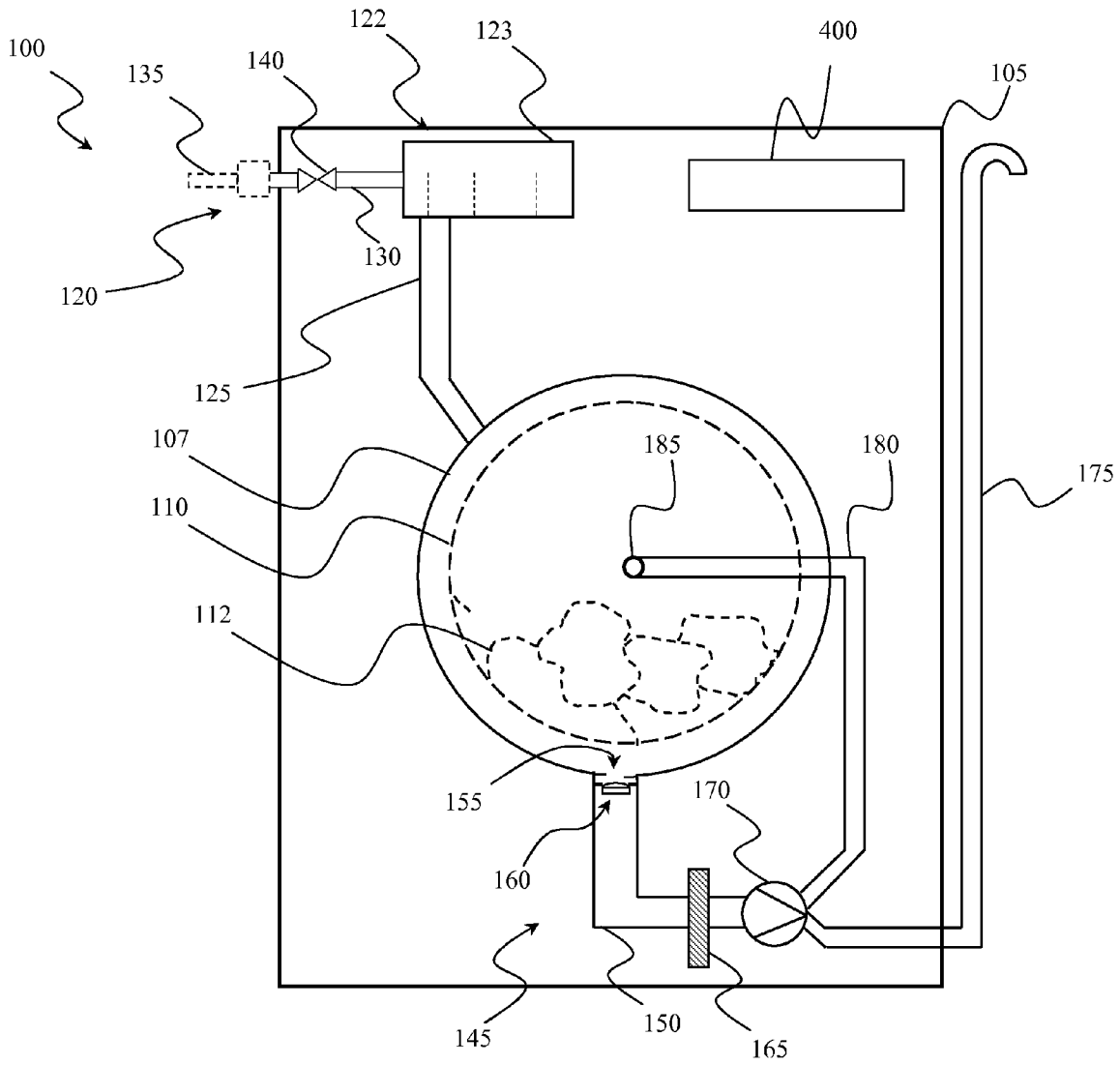
FIG. 1 is a schematic front view of a washing machine in which embodiments of the present invention may be implemented.

With reference to the drawings, FIG. 1 is a front view of a washing machine 100 in which embodiments of the present invention may be implemented.

The washing machine 100 is a machine for treating (washing, or washing/drying) laundry of the front-loading type. Anyway, it should be apparent from the following description that aspects of the inventions can be applied, without any substantial modification, to a washing machine of the top-loading type.

In the example at issue, the washing machine 100 advantageously comprises a preferably substantially parallelepiped-shaped casing 105 that encloses a washing tub 107 wherein laundry is treated, along with any other components of the washing machine 100 necessary for the operation (e.g., hydraulic, electronic and electromechanical apparatuses known in the art and, therefore, not herein described for sake of conciseness). The washing tub 107 has preferably a substantially cylindrical shape and is made of waterproof material which is also able to withstand operating temperatures and chemicals reactions promoted by washing liquids during the washing machine operation, such as a plastic polymer.

The washing tub 107 houses a rotatable perforated drum 110, preferably substantially cylindrical-shaped, in which laundry 112 to be washed can be loaded.

In order to allow a user to access the washing tub and the inside of the drum 110 (for loading/unloading the laundry), a loading/unloading opening closable by a door, not illustrated, is advantageously provided, preferably on a front side of the washing machine 100.

A water supply system 120 and a detergent supply system 122 are arranged preferably in the upper part of the washing machine 100 for supplying washing liquid into the washing tub 107. The detergent supply system 122 advantageously comprises a removable drawer 123 provided with compartments suited to be filled with washing and/or rinsing products.

Water flowing through the water supply system 120 is advantageously supplied into the washing tub 107 by making it flow through the drawer 123 and through an inlet line 125 in fluid communication with the washing tub 107. Advantageously, the water supply system 120 further comprises a main pipe 130 fluidly connecting the drawer 123 to an external water supply line 135, preferably by means of a controlled input supply valve 140.

Washing liquid which reaches the washing tub 107 may selectively contain one of the products (e.g. detergent, softener, bleach) contained in the compartments of the drawer 123, or may be clean water (i.e., which does not contain any product), depending on the washing program which is actually performed. Alternative arrangements may be provided, for example with a separate water inlet line adapted to supply exclusively clean water into the washing tub 107.

The washing machine 100 is provided with a discharge system 145 adapted to selectively remove (or drain) washing/rinsing liquid from the washing tub 107.

The discharge system 145 comprises a discharge duct 150 fluidly connected to the washing tub 107 for receiving the washing/rinsing liquid to be discharged. The discharge duct 150 may be made of a rigid material, such as plastic. Anyway, in a further advantageous embodiment, the discharge duct 150 may be a flexible hose, for example made of a flexible material, such as rubber. The discharge duct 150 is arranged to be, preferably selectively, in fluid communication with the washing tub 107 through a discharge hole 155 provided at the bottom of the washing tub 107. Preferably, a valve 160 is provided for selectively opening/closing the discharge hole 155, in order to selectively allow/block liquid to flow between the washing tub and 107 the discharge duct 150. Downstream the valve 160, an anti-fluff/anti-clog filter 165 is preferably provided.

Downstream the anti-fluff/anti-clog filter 165, a pump 170 is provided, which is operable to selectively cause liquid located into the discharge duct 150 to be discharged through a drain hose 175 adapted to be connected to a water drain network system (not illustrated), or to be conveyed back into the washing tub 107 through a recirculation conduit 180, preferably for being sprayed inside the drum 110, e.g., by means of nozzle(s) 185 located on the drum 110 in proximity of the rotation axis thereof.

Figure 2A:
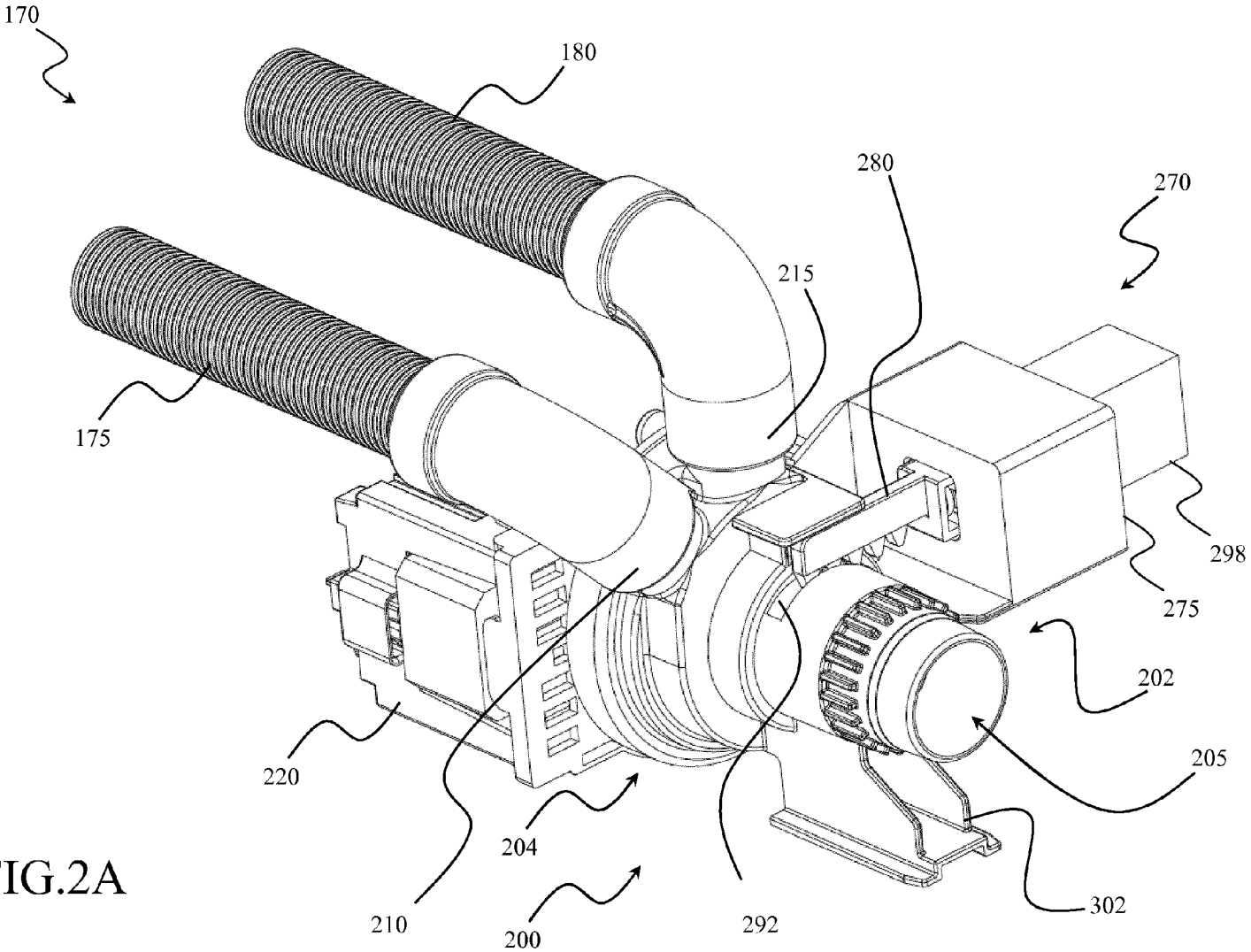
FIG. 2A is a perspective view of a pump of the washing machine of FIG. 1 according to an embodiment of the present invention.
Figure 2B:
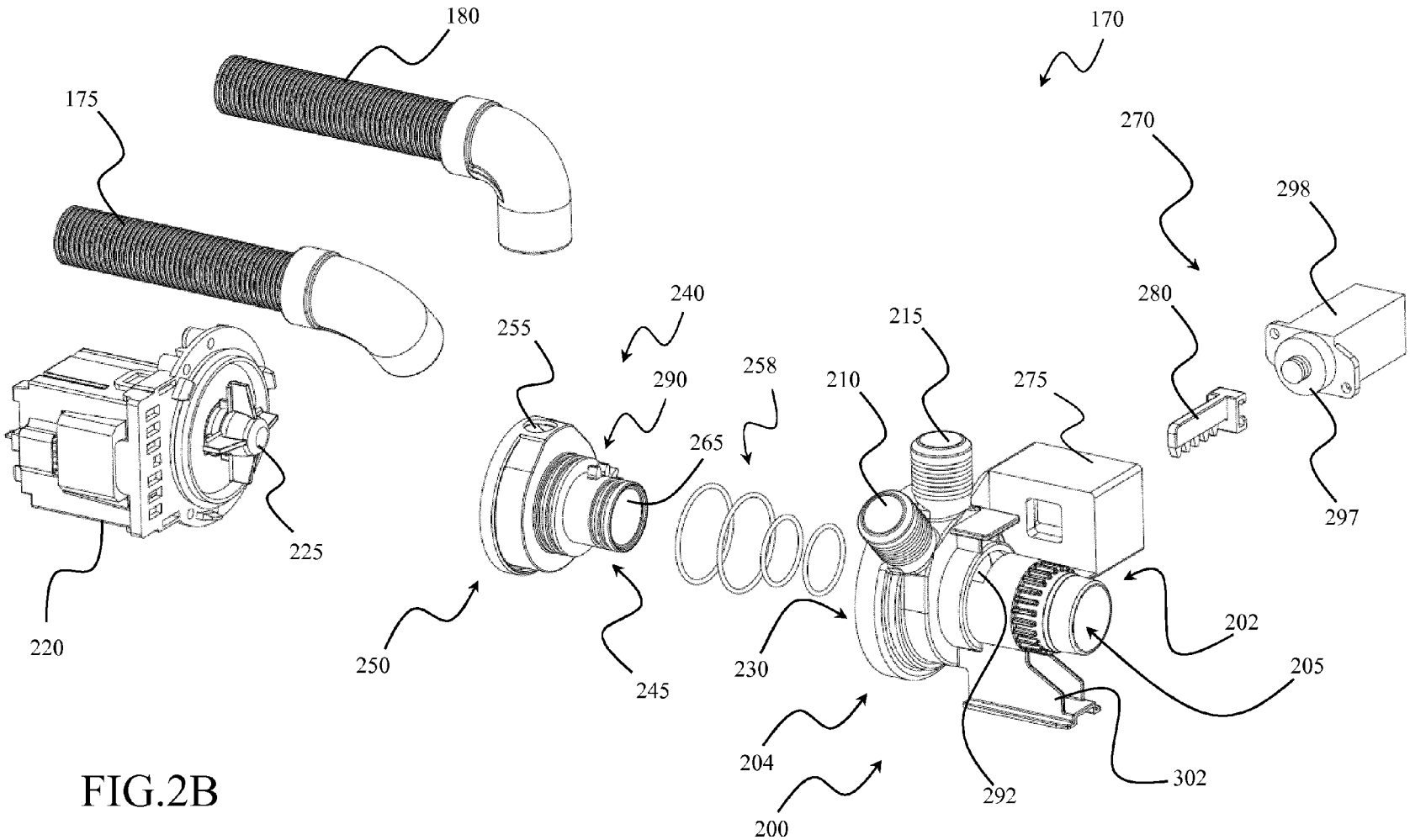
FIG. 2B is a partially exploded view of the pump of FIG. 1.

FIG. 2A is a perspective view of the pump 170 according to an advantageous embodiment of the present invention. FIG. 2B is a partially exploded view of the pump of FIG. 2A.

The pump 170 comprises a hollow pump body 200, for example made of plastic material, having an input portion 202 and an output portion 204. In the example at issue, both the input portion 202 and the output portion 204 of the pump body 200 have substantially the shape of hollow cylinders; preferably the input portion 202 has a diameter lower than the one of the output portion 204. Similar considerations apply if the input portion 202 and the output portion 204 have different shapes and/or sizes. The input portion 202 and the output portion 204 are connected to each other, with an end of the input portion 202 that is linked to an end of the output portion 204. The pump 170 has an input port 205 located preferably at a free end of the input portion 202, and connected to the discharge duct 150 (see FIG. 1). The pump 170 comprises some output ports, preferably two, located preferably on a lateral surface of the output portion 204: a drain output port 210 connected to the drain hose 175, and a recirculation output port 215 connected to the recirculation conduit 180.

A pump driving motor 220, preferably an electric motor, is operable to rotate an impeller 225. The pump driving motor 220 is advantageously connected to a free end of the output portion 204, so as to define, together with the output portion, a pump chamber 230 (which is therefore delimited by the pump body 200 and by the housing of the pump driving motor 220 itself), in which the impeller 225 is housed. The discharge duct 105, the drain hose 175 and the recirculation conduit 180 are adapted to be brought in fluid communication with the pump chamber 230 through the input port 205, the drain output port 210 and the recirculation output port 215, respectively.

When the pump driving motor 220 is active, and the impeller 225 is in rotation, washing liquid coming from the discharge duct 150 is sucked into the pump chamber 230 through the input port 205.

As will be described in detail in the following, pump 170 is operable to selectively cause the washing liquid entering into the pump chamber 230 to be recirculated into the drum 110 through the recirculation output port 215, the recirculation conduit 180 and the nozzles 185 (see FIG. 1), or discharged toward the water drain network system through the drain output port 210 and the drain hose 175 (see FIG. 1).

For this purpose, according to an embodiment of the present invention, a diverter element 240 is provided, adapted to selectively close at least one between the recirculation output port 215 and the drain output port 210 while keeping the other one opened. The diverter element 240 is preferably in the form of a hollow member rotatably arranged in the pump chamber 230, upstream the recirculation output port 215 and the drain output port 210. In the embodiment illustrated in the figures, the diverter element 240 has advantageously substantially the shape of a funnel, with a narrow portion 245 adapted to be rotatably fitted into the input portion 202 of the pump body 200, and a wide portion 250 adapted to be rotatably fitted into the output portion 204 of the pump body 202. Preferably, the diverter element 240 is made of a plastic rigid material. The diverter element 240 is preferably designed with an opening 255 located on the lateral surface of the wide portion 250. Advantageously, one or more gaskets 258, e.g., o-rings, are fitted around the outer surface of the diverter element 240 to make the latter watertight.

The diverter element 240 is operable to be movable (advantageously, in the embodiment illustrated in enclosed Figures, it is rotatable) into the pump chamber 230 from a first position, in which the opening 255 faces the recirculation output port 215, to a second position, in which the opening 255 faces the drain output port 210, and vice versa.

Figure 2C:
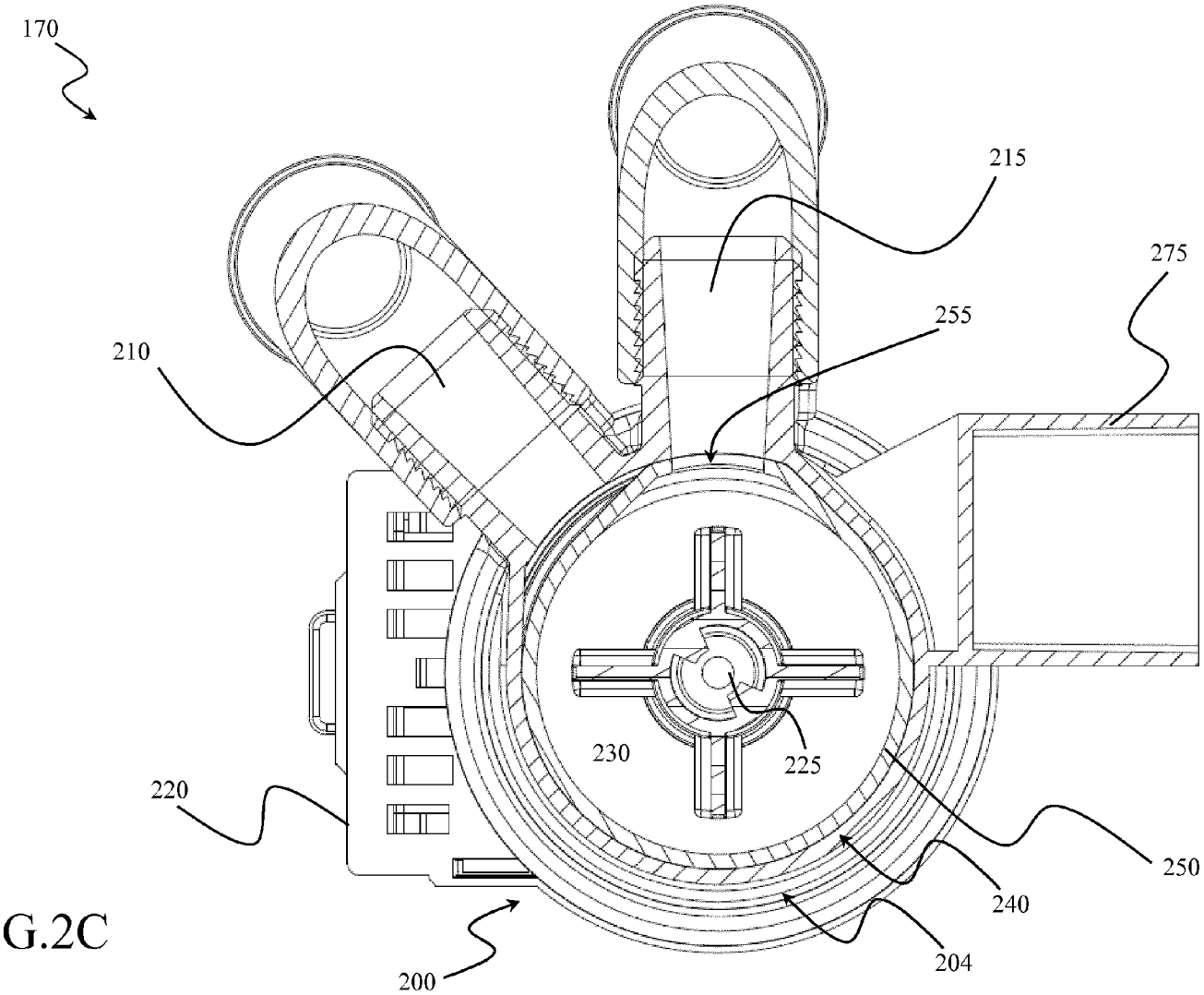
FIGS. 2C and 2D are two cross-sectional views of the pump of FIGS. 2A and 2B.

FIG. 2C is a cross-sectional view of the pump 170 taken along a plane perpendicular to the symmetry axis of the pump body 202 and crossing the recirculation output port 215 and the drain output port 210, in which the diverter element 240 is in the first position, i.e., with the opening 255 that faces the recirculation output port 215.

When the pump 170 is in operation, with the impeller 225 that rotates, washing liquid sucked through the input port 205 reaches the diverter element 240 through an input opening 265 located at a free end of the narrow portion 245 of the diverter element 250 and facing the input port 205 (see FIG. 2B).

If the diverter element 240 is in the first position, the drain output port 210 is blocked by a portion of the lateral surface of the diverter element 240 wide portion 250, while the recirculation output port 215 is open, since the opening 255 faces the output port 215. In this situation, the washing liquid is diverted to the recirculation conduit 180.

If instead the diverter element 240 is in the second position, the recirculation output port 215 is blocked by a portion of the lateral surface of the diverter element 240 wide portion 250, while the drain output port 210 is open, since the opening 255 faces the drain output port 210. In this situation, the washing liquid is diverted to the drain hose 175.

According to an embodiment of the present invention, the movement (advantageously, in the embodiment illustrated in enclosed Figures, this movement is a rotation) of the diverter element 240 that allows to switch between the first and the second positions is carried out by means of a linear actuator 270; preferably the linear actuator 270 is associated to a rack and pinion system, which preferably converts the linear motion of a rack (moved by the linear actuator) into a rotational motion of a pinion.

Preferably the linear actuator 270 is controlled by the electronic control system 400 (e.g. a programmable electronic board) of the washing machine 100, only schematically illustrated in FIG. 1, in such a way to take the diverter element 240 selectively in the first and second position, according to the phase of the specific washing program selected by the user (for example by a suitable user interface, not illustrated, provided in the washing machine) which is being performed.

According to an embodiment of the present invention, the linear actuator 270 is located outside the pump chamber 230, for example housed in a proper support 275 fixed to the pump body 200. The linear actuator 270 comprises a linear gear bar (rack) 280 having teeth that mesh with corresponding teeth 290 provided on the diverter element (pinion) 240. In the embodiment of the invention illustrated in FIGS. 2A and 2B, the teeth 290 are provided on (at least a portion of) the external surface of the narrow portion 245, and are exposed from the pump body 200 through a slit 292 located at the input portion 202 thereof.

Figure 2D:
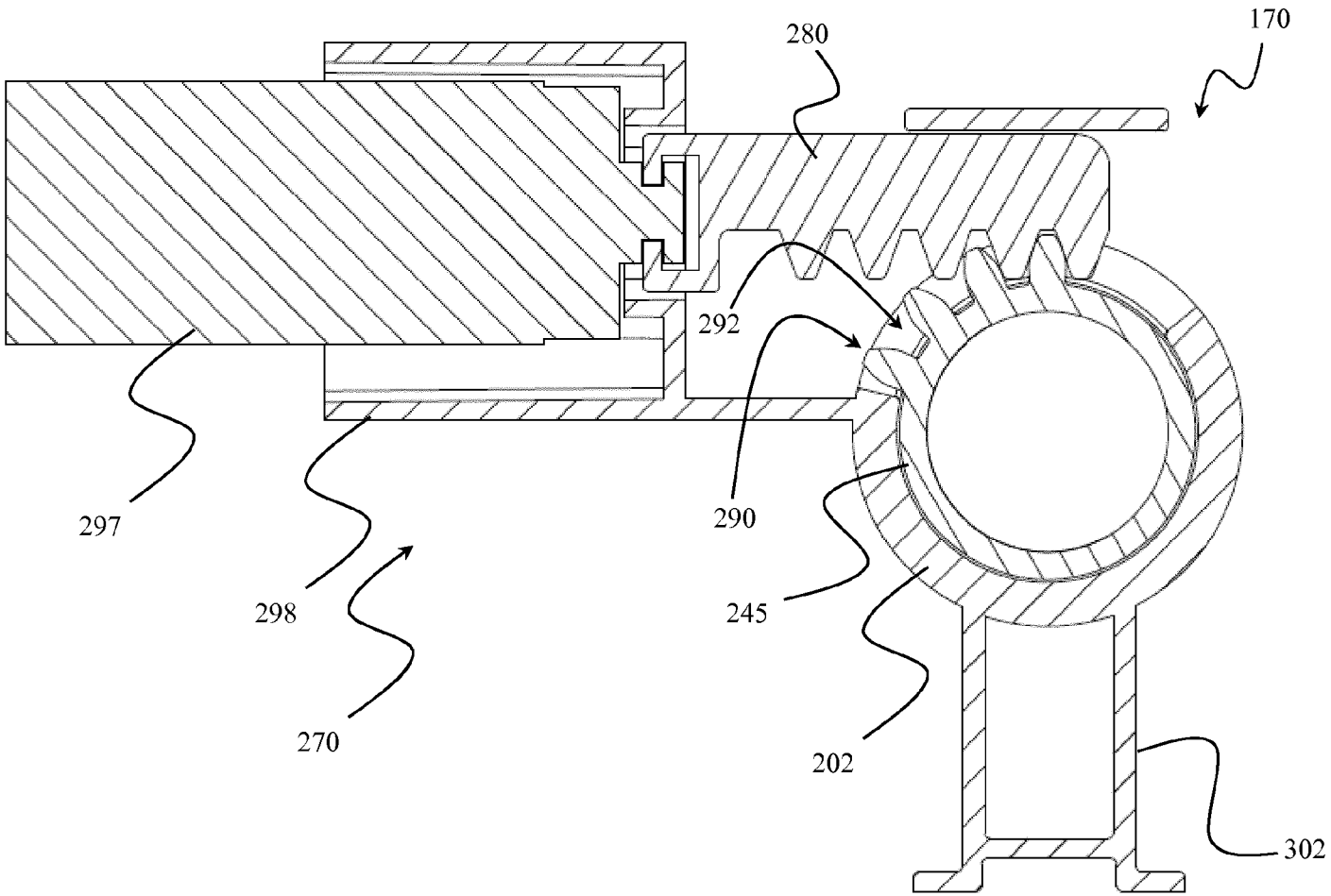

FIG. 2D is a cross-sectional view of the pump 170 taken along a plane perpendicular to the symmetry axis of the pump body 202 and crossing the linear gear bar 280 and the input portion 202 of the pump body 200 wherein the teeth 290 are located.

The linear gear bar 280 is operable to move along a linear direction from a first, retracted, position to a second, extended, position, and vice versa. The linear movement of the linear gear bar 280 is converted into a corresponding rotational movement of the diverter element 240 thanks to the mechanical interaction between the teeth of the linear gear bar 280 and the teeth 290 of the diverter element 240. Making reference to the example illustrated in the figures, when the linear gear bar 280 is in the retracted position, the diverter element 240 is in the first position, with the opening 255 thereof that faces the recirculation output port 215. If the linear gear bar 280 is moved toward its extended position, the diverter element 240 correspondingly rotates within the pump chamber 230.

The linear actuator 270 is designed so that when the linear gear bar 280 reaches its extended position, the diverter element 240 is in the second position, with the opening 255 thereof that faces the drain output port 210. The diverter element 240 is brought from the second position to the first position by moving the linear gear bar 280 in the opposite direction, i.e., toward its retracted position. Naturally, similar considerations apply if the linear actuator 270 is designed so that when the linear gear bar 280 reaches the retracted position, the diverter element 240 is in the second position, with the opening 255 thereof that faces the drain output port 210, and when reaches the extended position, the diverter element 240 is in the first position, with the opening 255 thereof that faces the recirculation output port 215.

The pump according to the present invention is very efficient and cost effective. Indeed, a single pump is used to fed two different hose/conduits, exploiting a diverter element that is able to rotate both in the clockwise and in the counterclockwise directions without the need of electric motors specifically designed to rotate in two directions, and without the need of expensive and not reliable additional gear mechanisms. Indeed, linear actuators designed to move a linear gear bar between two positions are cheap, simple and scarcely prone to jamming.

According to an embodiment of the present invention, the linear actuator 270 is a wax actuator, comprising a block of wax 297 enclosed in a box 298. The box 298 is provided with an opening exposing a portion of the block of wax 297. An end of the linear gear bar 280 is fixed to the exposed portion of the block of wax 297. Heating device, preferably an electric heater, is provided for selectively heating the block of wax 297. When the heating device is activated, the block of wax 297 is heated and it expands, driving the linear gear bar 280 outwards toward the extended position. When the heating device is deactivated, the block of wax 297 cools down and contracts, withdrawing the linear gear bar 280 toward the retracted position.

Instead of using a wax actuator as the linear actuator 270, the concepts of the present invention may be also applied to other linear actuators particularly suited to move a linear gear bar between two positions, such as, for example:

- an hydraulic or a pneumatic actuator, comprising a hollow cylinder having a piston, connected to the linear gear bar 280, inserted in it;
- a piezoelectric actuator, with the linear gear bar 280 connected to a block of a piezoelectric material, and
- an electromagnetic linear actuator, with the linear gear bar 280 connected to a moving coil.

Figure 3A:
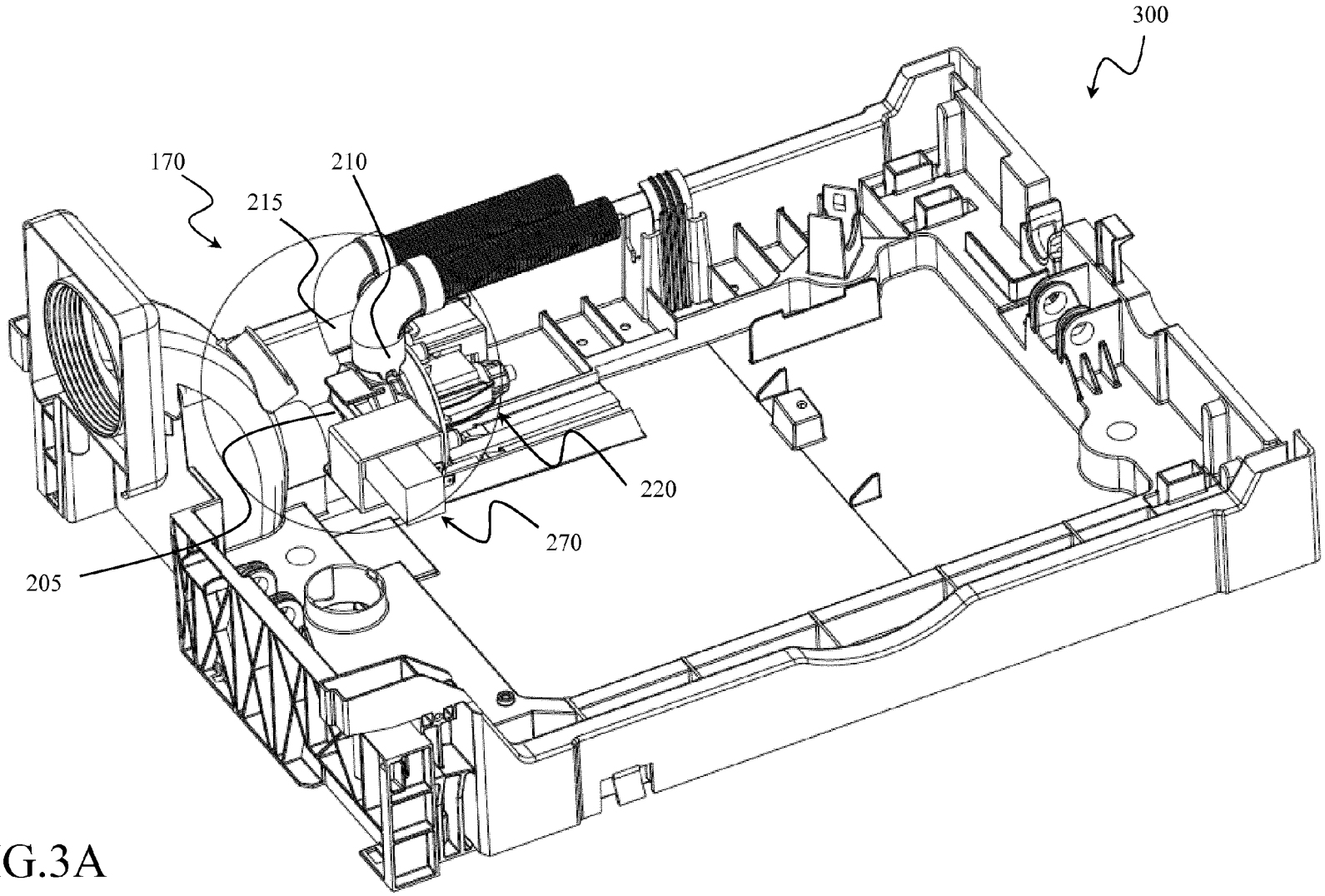
FIG. 3A is a perspective view of the pump of FIGS. 2A-2D when installed in a basement element of the washing machine of FIG. 1.

As illustrated in FIG. 3A, the pump 170 according to the embodiments of the present invention may be installed in a basement element 300 which closes the casing 105 of the washing machine 100 at its bottom portion for housing and supporting at least some of the components of the washing machine 100 necessary for its operation. For this purpose, the pump 170 is advantageously provided with a support element 302 protruding from the body pump 200 (see FIGS. 2A, 2B and 2D) and adapted to be fixed to a corresponding portion of the basement element 300, for example by means of snap-fit engagements, pins, screws, glue or soldering.

Figure 3B:
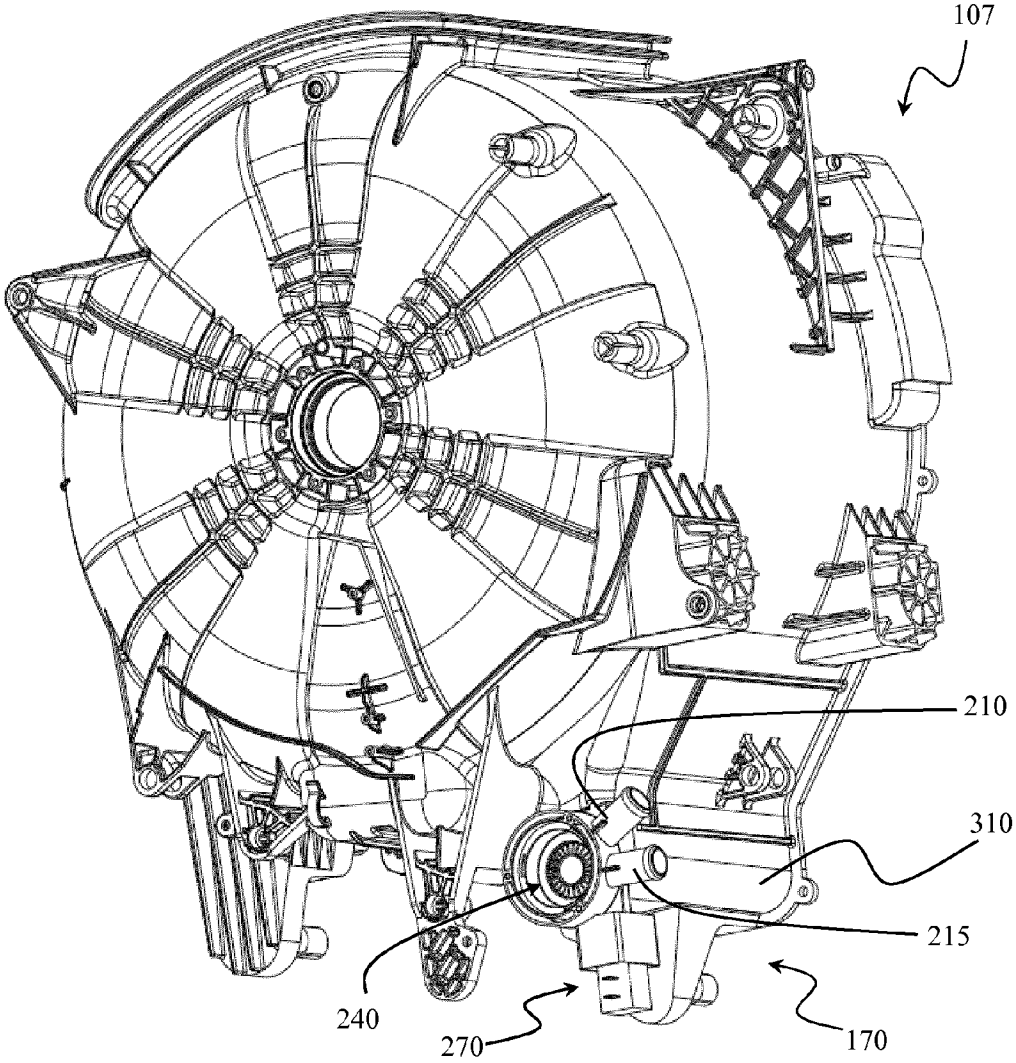
FIG. 3B is a perspective view of the pump of FIGS. 2A-2D when installed on a washing tub of the washing machine of FIG. 1.

As illustrated in FIG. 3B, instead of installing the pump 170 in the basement element 300, according to an embodiment of the present invention the pump 170 may be directly installed on a bottom portion of the washing tub 107, for example inserted in a support element 310 which protrudes downward from the washing tub 107 near the discharge hole 155.

Naturally, in order to satisfy local and specific requirements, a person skilled in the art may apply to the solution described above many logical and/or physical modifications and alterations.

The invention claimed is:

1. A laundry washing machine comprising:

a washing tub in which washing/rinsing liquid may be loaded;

a rotatable perforated drum, in which laundry to be washed can be loaded;

a discharge system fluidly connected to the washing tub and adapted to selectively discharge washing/rinsing liquid from the washing tub, said discharge system including a discharge duct coupled with the washing tub for receiving washing/rinsing liquid to be discharged;

a pump operable to selectively cause washing/rinsing liquid located in the discharge duct to be discharged through a drain hose or to be conveyed back into the washing tub through a recirculation conduit, wherein said pump comprises:

a) a pump chamber for receiving washing/rinsing liquid from the discharge duct, the pump chamber housing an impeller;

b) a diverter element rotatably arranged in said pump chamber and movable by rotation between a first position, in which said diverter element causes washing/rinsing liquid in the pump chamber to be diverted to said recirculation conduit, and a second position, in which said diverter element causes washing/rinsing liquid in the pump chamber to be diverted to said drain hose;

wherein said diverter element rotates around the impeller.

2. The laundry washing machine of claim 1 wherein said pump comprises a linear actuator coupled to said diverter element and operable to move said diverter element between said first and second position.

3. The washing machine of claim 2, wherein said linear actuator comprises a linear gear bar having teeth that mesh with corresponding teeth provided on said diverter element.

4. The washing machine of claim 3, wherein said linear gear bar is operable to be moved along a linear direction between a retracted position and an extended position, the movement of said linear gear bar along said linear direction being converted into a corresponding rotational movement of said diverter element by means of mechanical interaction of the teeth of said linear gear bar with the teeth provided on said diverter element.

5. The washing machine of claim 4, wherein:

when said linear gear bar is in said retracted position, said diverter element is in said first position, and when said linear gear bar is in said extended position, said diverter element is in said second position, or when said linear gear bar is in said retracted position, said diverter element is in said second position, and when said linear gear bar is in said extended position, said diverter element is in said first position.

6. The washing machine of claim 5, wherein said linear actuator comprises:

a block of wax, an end of said linear gear bar being fixed to a portion of said block of wax, and a heating device operable to selectively heat said block of wax.

7. The washing machine of claim 4, wherein said linear actuator comprises:

a block of wax, an end of said linear gear bar being fixed to a portion of said block of wax, and a heating device operable to selectively heat said block of wax.

8. The washing machine of claim 3, wherein said linear actuator comprises:

a block of wax, an end of said linear gear bar being fixed to a portion of said block of wax, and a heating device operable to selectively heat said block of wax.

9. The washing machine of claim 8, wherein:

when said heating device is activated, said block of wax is heated and expands, driving said linear gear bar toward said extended position, and when said heating device is deactivated, said block of wax cools down and contracts, driving said linear gear bar toward said retracted position.

10. The washing machine of claim 2, wherein said linear actuator is controlled by an electronic control system of said washing machine, in such a way to selectively position said diverter element in said first or in said second position, according to a phase of a washing program selected by a user which is being performed.

11. The washing machine of claim 2, wherein:

a) said pump comprises:

an input port connected to said discharge duct;

a drain output port connected to said drain hose, and a recirculation output port connected to said recirculation conduit, wherein said discharge duct, said drain hose and said recirculation conduit are adapted to be brought in fluid communication with said pump chamber through said input port, said drain output port and said recirculation output port, respectively, and wherein b) said diverter element is arranged in such a way to block said drain output port and to keep opened said recirculation output port when in said first position, and to block said recirculation output port and to keep opened said drain output port when in said second position.

12. The washing machine of claim 2, wherein said linear actuator comprises a linear gear bar having teeth that mesh with corresponding teeth provided on said diverter element.

13. The washing machine of claim 1, wherein:

a) said pump comprises:

an input port connected to said discharge duct;

a drain output port connected to said drain hose, and a recirculation output port connected to said recirculation conduit, wherein said discharge duct, said drain hose and said recirculation conduit are adapted to be brought in fluid communication with said pump chamber through said input port, said drain output port and said recirculation output port, respectively, and wherein b) said diverter element is arranged in such a way to block said drain output port and to keep opened said recirculation output port when in said first position, and to block said recirculation output port and to keep opened said drain output port when in said second position.

14. The washing machine of claim 13, wherein said diverter element comprises a hollow member provided with:

an input opening facing said input port, and a further opening arranged in such a way to face said recirculation output port when said diverter element is in said first position, and adapted to face said drain output port when said diverter element is in said second position.

* * * * *